US012378784B2

(12) United States Patent
Wang

(10) Patent No.: US 12,378,784 B2
(45) **Date of Patent: *Aug. 5, 2025**

(54) TWO-WAY RETRACTABLE BUILDING FORMWORK APPARATUS

(71) Applicant: Chien-Ho Wang, Taichung (TW)

(72) Inventor: Chien-Ho Wang, Taichung (TW)

( * ) Notice: Subject to any disclaimer, the term of this patent is extended or adjusted under 35 U.S.C. 154(b) by 354 days.

This patent is subject to a terminal disclaimer.

(21) Appl. No.: 18/095,414

(22) Filed: Jan. 10, 2023

(65) Prior Publication Data

US 2023/0265668 A1 Aug. 24, 2023

(30) Foreign Application Priority Data

Feb. 23, 2022 (TW) ..... 111106586

(51) Int. Cl.
*E04G 11/08* (2006.01)
*E04G 9/08* (2006.01)

(52) U.S. Cl.
CPC ..... *E04G 9/08* (2013.01); *E04G 11/082* (2013.01)

(58) Field of Classification Search
CPC ..... E04G 11/06; E04G 11/08; E04G 11/082; E04G 9/08; E04G 9/083
See application file for complete search history.

(56) References Cited

U.S. PATENT DOCUMENTS 2,107,427 A * 2/1938 Schwarzler ..... E04G 11/14 249/189
2,818,627 A * 1/1958 Blasius ..... B28B 7/22 249/153
3,814,374 A * 6/1974 Beemer ..... B28B 7/22 249/183
3,894,711 A * 7/1975 Van der Lely ..... E04G 11/10 249/185

(Continued)

FOREIGN PATENT DOCUMENTS

CN 106088573 A 11/2016
CN 210342655 U 4/2020

(Continued)

OTHER PUBLICATIONS

Search Report issued to European counterpart application No. 23151155.1 by the EPO on Jul. 19, 2023.

(Continued)

*Primary Examiner* — Kyle J. Walraed-Sullivan
(74) *Attorney, Agent, or Firm* — DLA PIPER LLP (US); Blake W. Jackson

(57) ABSTRACT

A two-way retractable building formwork apparatus includes a substrate module having a mounting surface, a first side bar mounted on one end of the mounting surface that extends along a first direction, a second side bar mounted on another end of the mounting surface that extends along a second direction transverse to the first direction and fixed to one end of the first side bar, a first (Continued)

retractable unit mounted on the mounting surface opposite to the first side bar and extendable along the first direction to fixedly connect to the second side bar, and a second retractable unit mounted on the mounting surface opposite to the second side bar, extendable along the second direction to fixedly connect to the first side bar, and further connected to the first retractable unit.

5 Claims, 14 Drawing Sheets

(56) References Cited

U.S. PATENT DOCUMENTS 4,055,321 A * 10/1977 Schimmel ..... B28B 7/22 249/185
4,202,145 A * 5/1980 Coulter ..... E04G 11/365 52/294
4,465,257 A * 8/1984 Schimmel ..... E04G 11/02 249/185
4,520,988 A * 6/1985 Walker ..... E04G 11/082 249/185
4,520,989 A * 6/1985 Digh ..... E04G 11/082 249/185
2002/0117602 A1* 8/2002 Ward ..... E04G 9/06 52/630
2004/0056172 A1* 3/2004 Sedran ..... E04G 9/05 249/35
2011/0278432 A1* 11/2011 Sollars ..... E04G 17/00 249/189

FOREIGN PATENT DOCUMENTS

CN 210369882 U 4/2020
CN 112942827 6/2021
CN 112982966 A * 6/2021 ..... E04G 13/00
CN 117344967 A * 1/2024 ..... E04G 15/02
FR 2692616 A1 * 12/1993 ..... E04G 11/082
JP H05125824 A 5/1993
JP H08302998 A 11/1996
KR 20090047922 A 5/2009

OTHER PUBLICATIONS

Search Report appended to an Office Action, which was issued to Taiwanese counterpart application No. 111106586 by the TIPO on Sep. 7, 2022, with an English translation thereof.

* cited by examiner

TWO-WAY RETRACTABLE BUILDING FORMWORK APPARATUS

CROSS-REFERENCE TO RELATED APPLICATION

This application claims priority to Taiwanese Invention Patent Application No. 111106586, filed on Feb. 23, 2022.

FIELD

The disclosure relates to a building formwork, and more particularly to a two-way retractable building formwork apparatus.

BACKGROUND

An existing building formwork apparatus, as disclosed in Taiwanese Patent No. I716319, includes at least four formworks and at least one connecting hornbeam block. Each formwork has a mold surface at one side thereof, a mounting surface opposite to the mold surface, and two connecting posts disposed on upper and lower ends of the mounting surface. Each connecting post has a plurality of through holes. The connecting hornbeam block has a plurality of connecting holes.

After the formworks are brought to align with and abut against each other, the connecting hornbeam block is then disposed on the connecting posts of the formworks, after which a plurality of fasteners are extended through the through holes and the connecting holes to fix the formworks and the connecting hornbeam block, thereby forming the existing building formwork apparatus.

Grout is poured between two existing building formwork apparatuses to make a wall. Since the dimensions of the wall differ due to different engineering works, and since there is no way to have a standard building formwork apparatus available, assembly of the existing building formwork apparatuses may not conform to the desired dimensions of the wall to be made, so that it is necessary to customize the existing building formwork apparatus so as to conform to the desired dimensions of the wall to be constructed.

SUMMARY

Therefore, an object of the present disclosure is to provide a two-way retractable building formwork apparatus that can alleviate at least one of the drawbacks of the prior art.

Accordingly, the two-way retractable building formwork apparatus of this disclosure comprises a substrate module having a mounting surface, a first side bar mounted on one end of the mounting surface that extends along a first direction, a second side bar mounted on another end of the mounting surface that extends along a second direction transverse to the first direction and fixed to one end of the first side bar, a first retractable unit mounted on the mounting surface opposite to the first side bar and extendable along the first direction to fixedly connect to the second side bar, and a second retractable unit mounted on the mounting surface opposite to the second side bar and extendable along the second direction to fixedly connect to the first side bar. The second retractable unit is further connected to the first retractable unit.

BRIEF DESCRIPTION OF THE DRAWINGS

Other features and advantages of the disclosure will become apparent in the following detailed description of the embodiments with reference to the accompanying drawings. It is noted that various features may not be drawn to scale.

DETAILED DESCRIPTION

Figure 1:
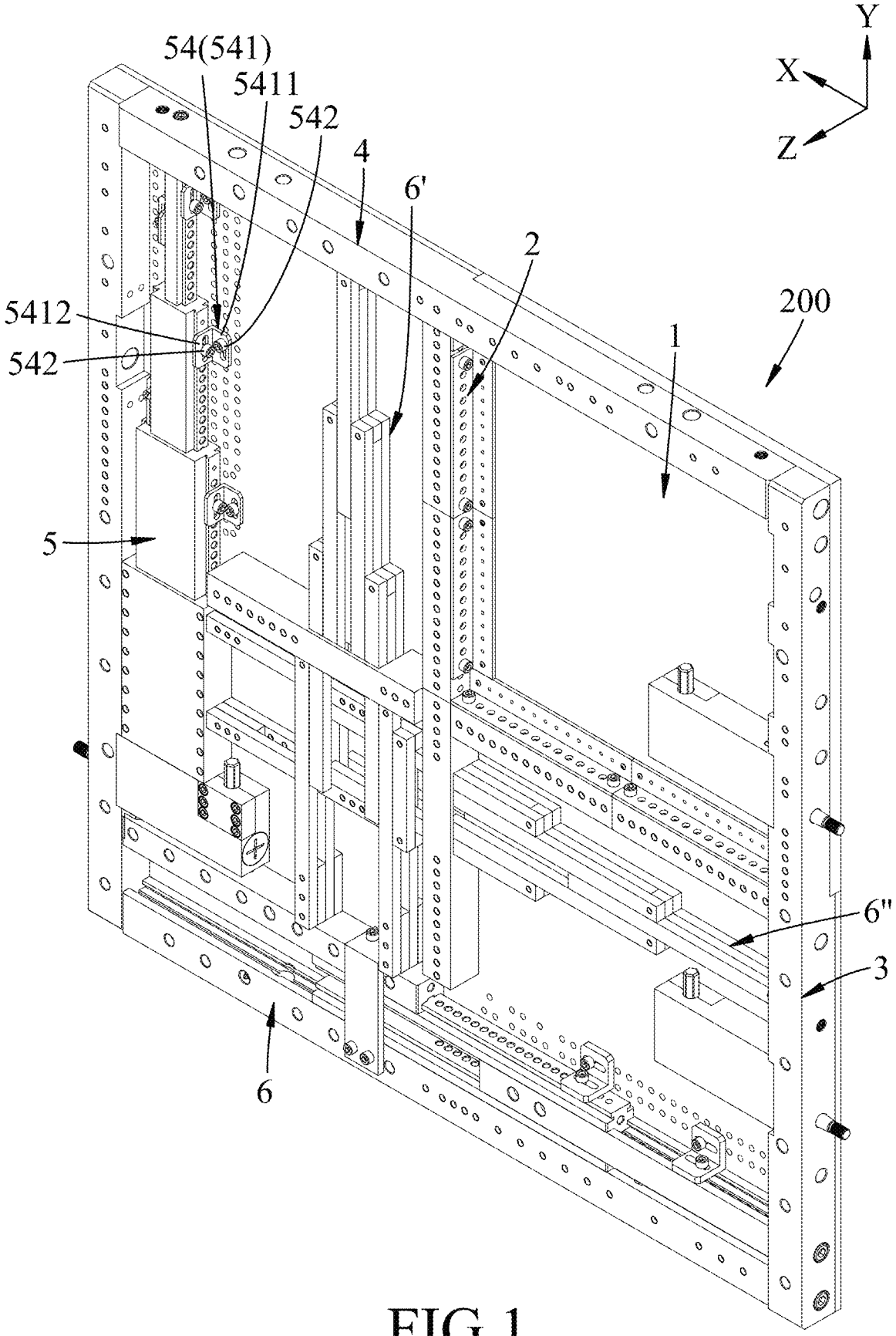
FIG. 1 is a perspective view of a two-way retractable building formwork apparatus according to the first embodiment of the present disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 1 to 5, a two-way retractable building formwork apparatus 200 according to the first embodiment of the present disclosure includes a substrate module 1, a fixing unit 2, a first side bar 3, a second side bar 4, a first retractable unit 5, and a second retractable unit 6.

The substrate module 1 includes a first substrate 11, a second substrate 12, a third substrate 13, and a fourth substrate 14. The second substrate 12 is connected side by side to the first substrate 11 along a first direction (Y). The third substrate 13 is connected side by side to the first substrate 12 along a second direction (X) transverse to the first direction (Y). The fourth substrate 14 is connected side by side to the second substrate 12 along the second direction (X), and is connected side by side to the third substrate 13 along the first direction (Y). The first to fourth substrates 11 to 14 cooperatively define a mounting surface 15 and a mold surface 16 opposite to the mounting surface 15 along a mounting direction (Z) transverse to the first and second directions (X, Y). In this embodiment, each of the first to third substrates 11, 12, 13 is a steel plate, while the fourth substrate 14 is a wooden board.

Figure 4:
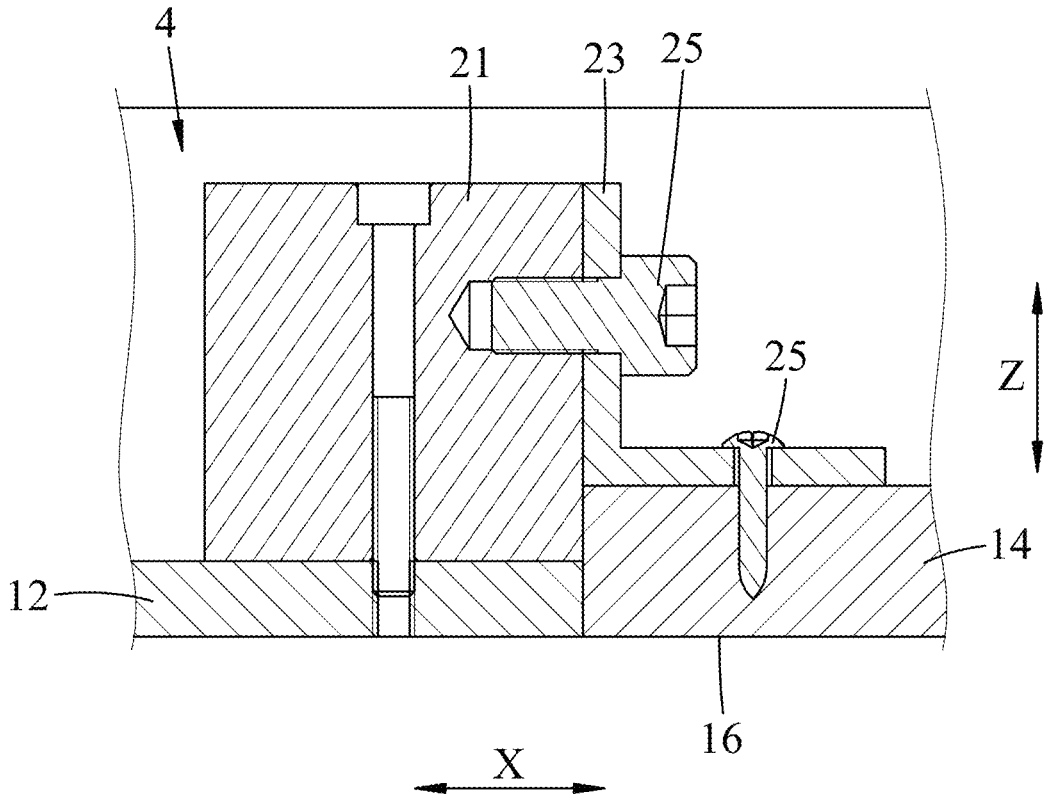
FIG. 4 is a sectional view taken along line IV-IV of FIG. 3.
Figure 5:
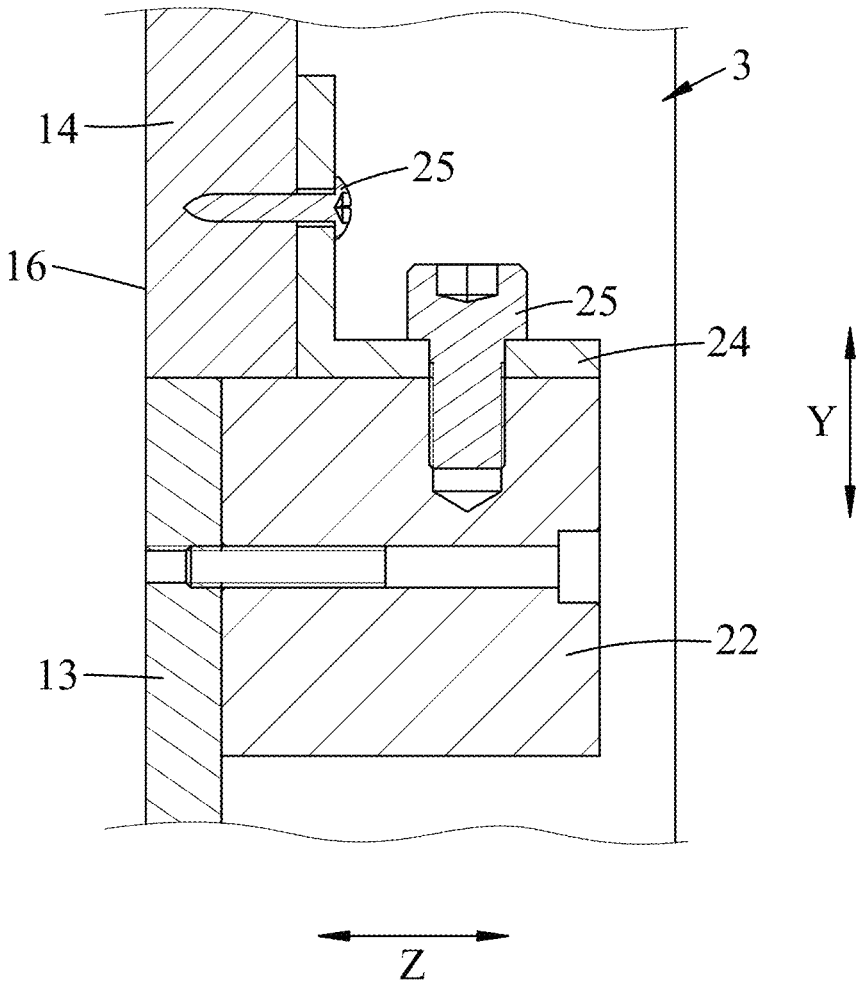
FIG. 5 is a sectional view taken along line V-V of FIG. 3.

With reference to FIGS. 4 and 5, the mold surface 16 is flat, and the fourth substrate 14 has a thickness along the mounting direction (Z) greater than a thickness of any one of the first substrate 11 (see FIG. 8), the second substrate 12 and the third substrate 13 along the mounting direction (Z).

In other variations of this embodiment, the thickness of the fourth substrate 14 may be equal to the thickness of any one of the first to third substrates 11 to 13, but not limited thereto.

The fixing unit 22 includes two first connecting rods 21, two second connecting rods 22, three first fixing plates 23, two second fixing plates 24, and a plurality of connecting screws 25.

The first connecting rods 21 extend along the first direction (Y), are stacked one on top of the other along the first direction (Y), and are fixed to one end of the second substrate 12 such that they abut against an inner end of the fourth substrate 14 that extends along the first direction (Y). The second connecting rods 22 are disposed side by side along the second direction (X), are fixed to the third substrate 13, and abut against an inner end of the fourth substrate 14 that extends along the second direction (X).

The first fixing plates 23 are stacked one on top of the other along the first direction (Y). Each first fixing plate 23 is an L-shaped plate having a first plate portion 231 fixed to a corresponding one of the first connecting rods 21, and a second plate portion 232 perpendicular to the first plate portion 231 and fixed to the inner end of the fourth substrate 14 that extends along the first direction (Y). The second fixing plates 24 are disposed side by side along the second direction (X). Each second side plate 24 is an L-shaped plate having a first plate portion 241 fixed to a corresponding one of the second connecting rods 22, and a second plate portion 242 perpendicular to the first plate portion 241 and fixed to the inner end of the fourth substrate 14 that extends along the second direction (X).

Some of the connecting screws 25 are used to fixedly fasten the first fixing plates 23 to the corresponding ones of the first connecting rods 21 and the inner end of the fourth substrate 14 that extends along the first direction (Y). The other ones of the connecting screws 25 are used to fixedly fasten the second fixing plates 24 to the respective second connecting rods 22 and the inner end of the fourth substrate 14 that extends along the second direction (X).

In other variations of this embodiment, the number of each of the first connecting rod 21, the second connecting rod 22, the first fixing plate 23 and the second fixing plate 24 may be one, but not limited thereto.

Figure 6:
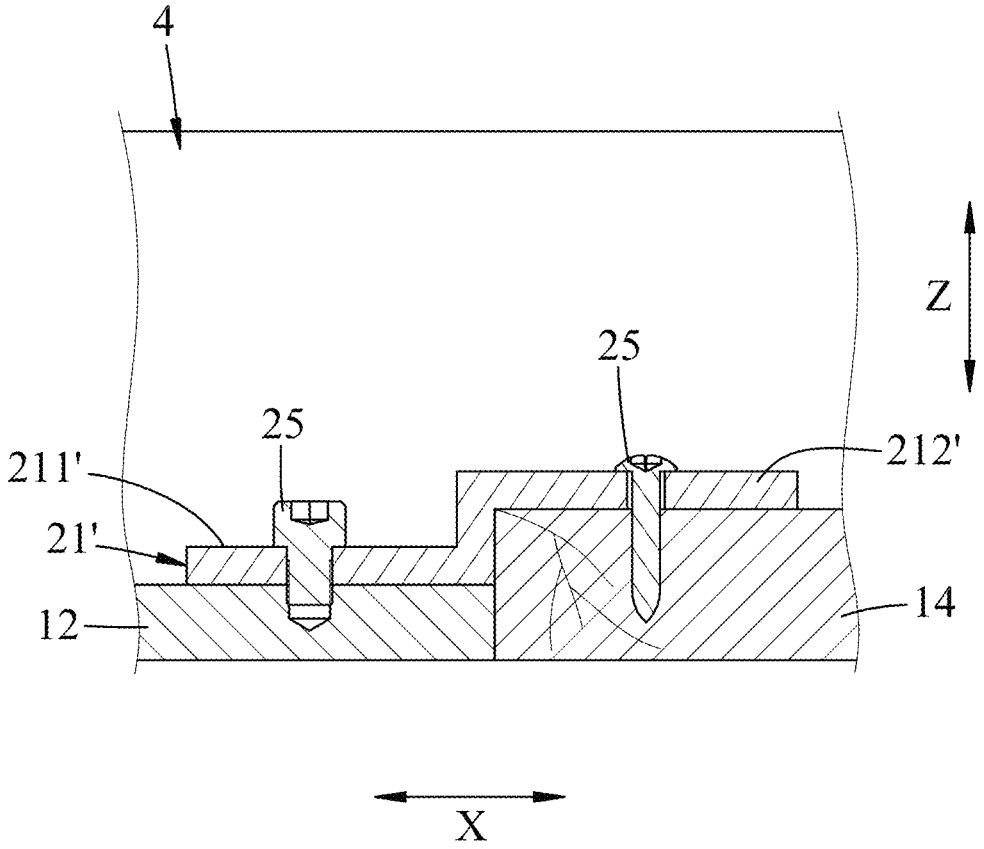
FIG. 6 is a view similar to FIG. 4, but illustrating an alternative form of the first embodiment.
Figure 7:
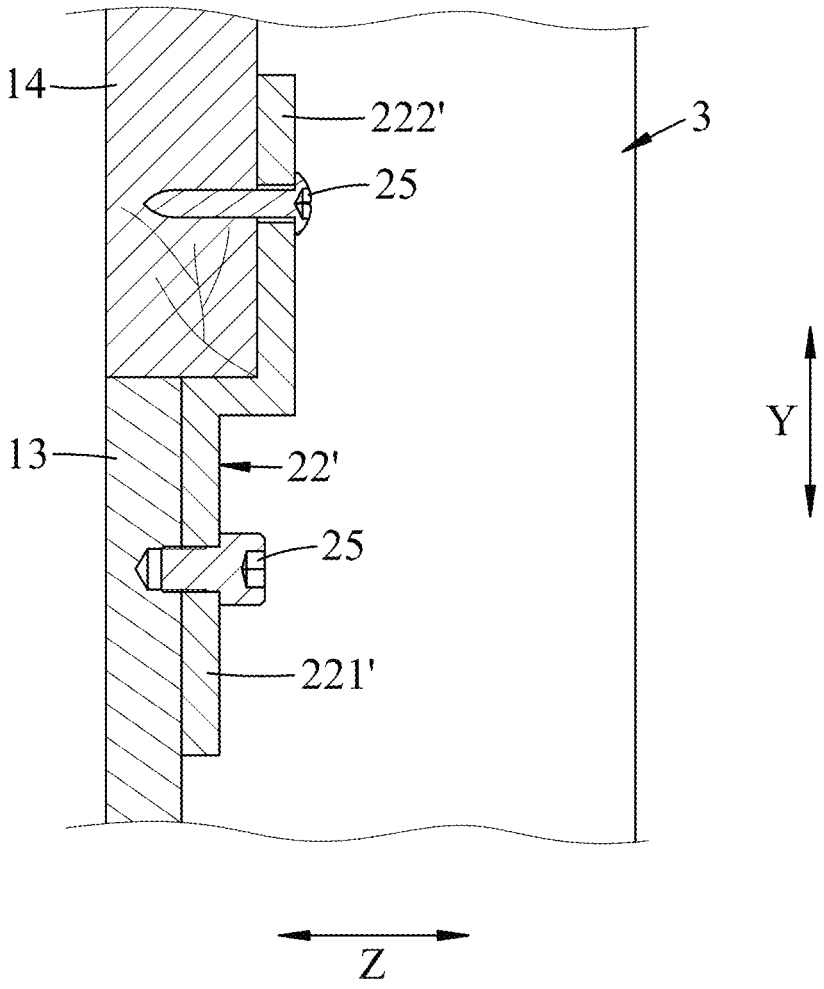
FIG. 7 is a view similar to FIG. 5, but illustrating the alternative form of the first embodiment.

FIGS. 6 and 7 illustrate an alternative form of the first embodiment. In this case, the fixing unit 2 further includes a first connecting plate 21' and a second connecting plate 22', but the first and second connecting rods 21, 22 and the first and second fixing plates 23, 24 are omitted herein. The first connecting plate 21' has a Z-shaped structure having two opposite plate portions 211', 212' connected fixedly and respectively to the second substrate 12 and the fourth substrate 14. The second connecting plate 22' also has a Z-shaped structure having two opposite plate portions 221', 222' connected fixedly and respectively to the third substrate 13 and the fourth substrate 14. Some of the connecting screws are used to fasten fixedly and respectively the plate portions 211', 212' to the second substrate 12 and the fourth substrate 14. The other ones of the connecting screws 25 are used to fasten fixedly and respectively the plate portions 221', 222' to the third substrate 13 and the fourth substrate 14.

Figure 2:
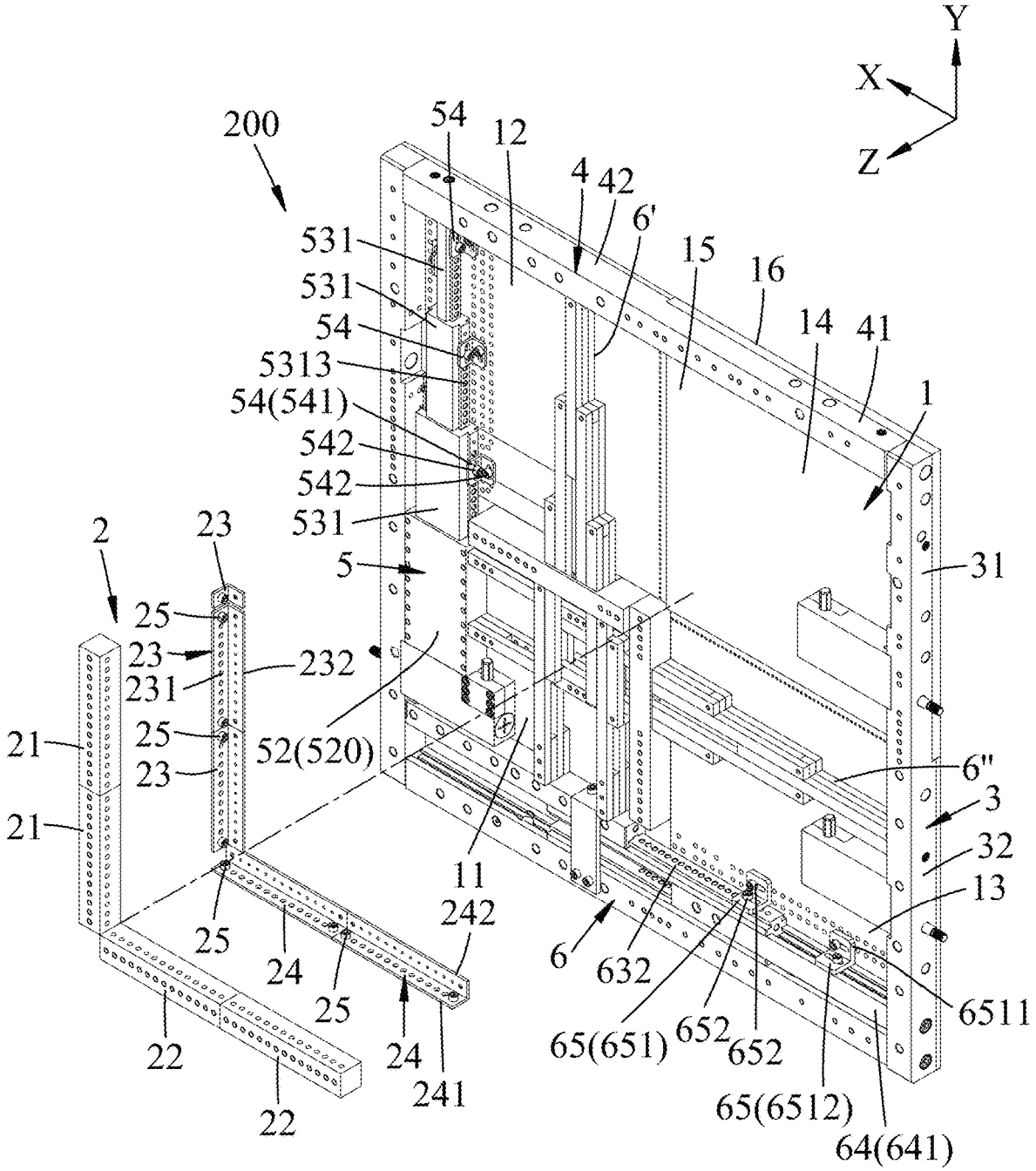
FIG. 2 is a view similar to FIG. 1, but with a fixing unit of the first embodiment removed.
Figure 3:
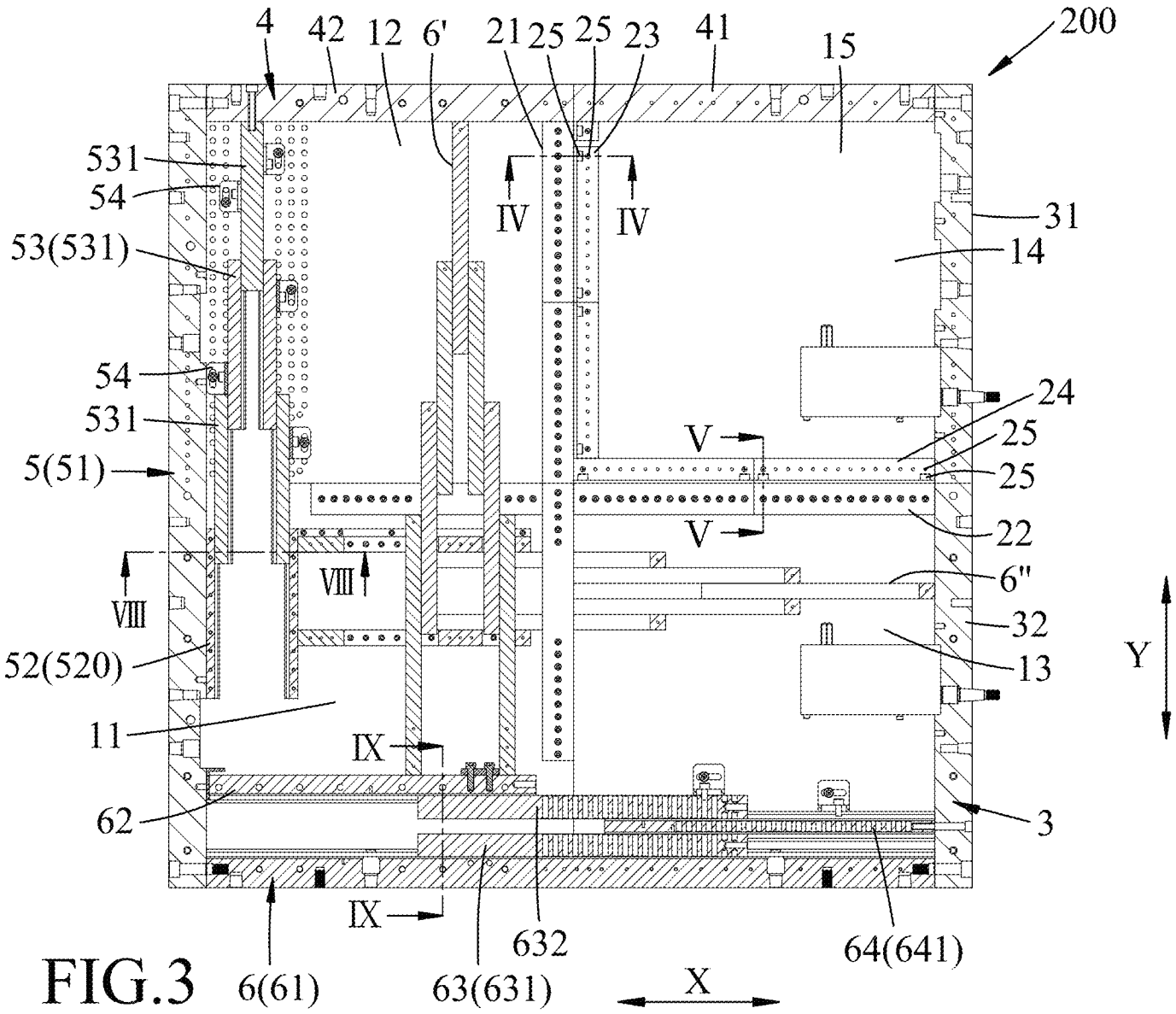
FIG. 3 is a sectional view of the first embodiment.

With reference to FIGS. 2 and 3, the first side bar 3 is mounted on one end of the mounting surface 15 that extends along the first direction (Y), and is fixedly connected to the third substrate 13 and the fourth substrate 14. The first side bar 3 has a first portion 31 abutting against the fourth substrate 14 and having a thickness along the mounting direction (Z), and a second portion 32 abutting against the third substrate 13 and having a thickness along the mounting direction (Z) greater than that of the first portion 31. As such, a thickness of a combination of the first side bar 3 and the third substrate 13 along the mounting direction (Z) is equal to a thickness of a combination of the first side bar 3 and the fourth substrate 14 along the mounting direction (Z).

The second side bar 4 is mounted on another end of the mounting surface 15 that extends along the second direction (X), and is fixedly connected to the second substrate 12, the fourth substrate 14 and one end of the first side bar 3. The second side bar 4 has a first portion 41 abutting against the fourth substrate 14 and having a thickness along the mounting direction (Z), and a second portion 42 abutting against the second substrate 12 and having a thickness along the mounting direction (Z) greater than that of the first portion 41. As such, a thickness of a combination of the second side bar 4 and the second substrate 12 along the mounting direction (Z) is equal to a thickness of a combination of the second side bar 4 and the fourth substrate 14 along the mounting direction (Z).

The first retractable unit 5 is mounted on the mounting surface 15 opposite to the first side bar 3, and is extendable along the first direction (Y) to fixedly connect to the second side bar 4. The second retractable unit 6 is mounted on the mounting surface 15 opposite to the second side bar 4, and is extendable along the second direction (X) to fixedly connect to the first side bar 3.

Figure 8:
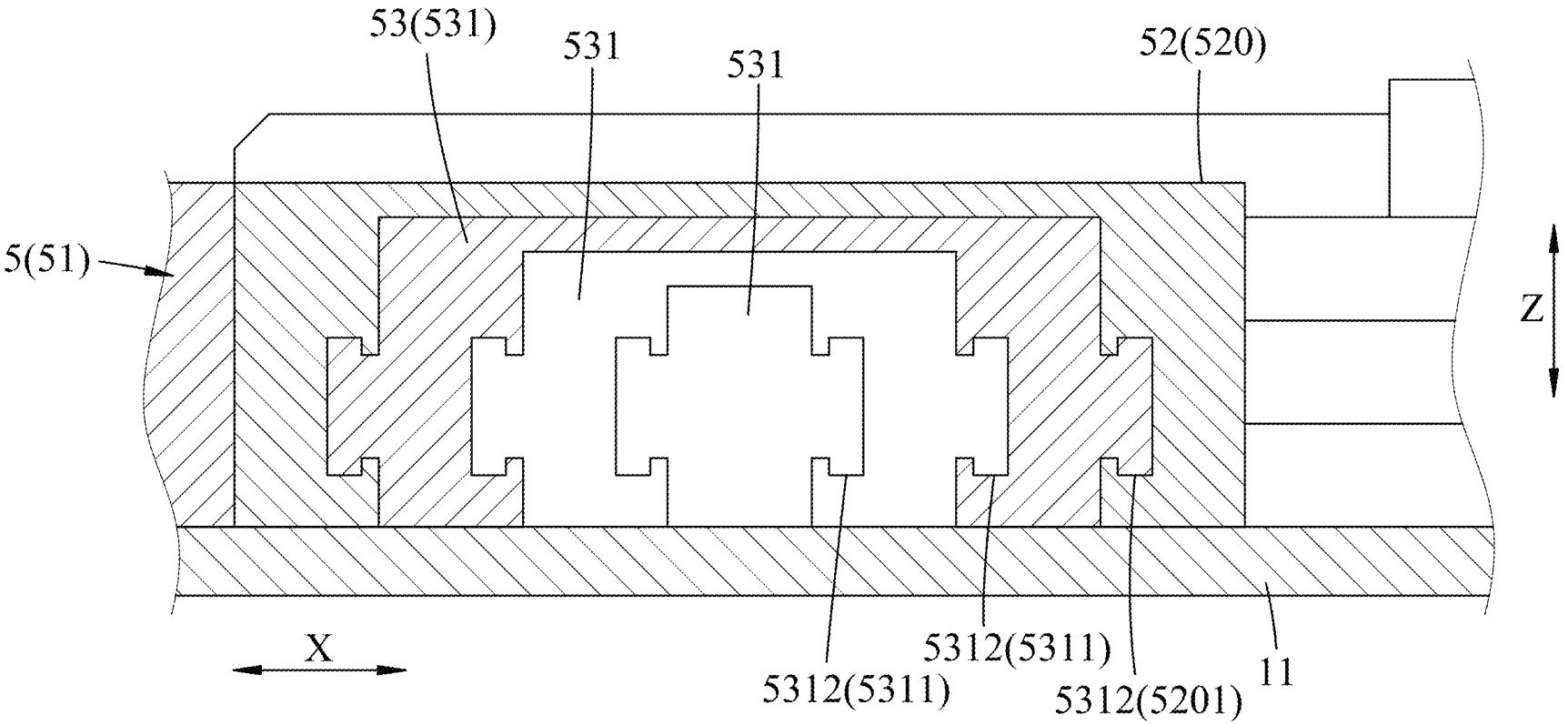
FIG. 8 is a sectional view taken along line VIII-VIII of FIG. 3.

Referring to FIG. 8, in combination with FIGS. 2 and 3, in this embodiment, the first retractable unit 5 includes a third side bar 51, a fixed plate assembly 52, a side plate assembly 53 and five first side connection assemblies 54.

The third side bar 51 extends along the first direction (Y), is mounted on a third end of the mounting surface 15 that is opposite to the one end thereof along the second direction (X), and is fixed between one end of the second side bar 4 that is opposite to the one end of the first side bar 3 and the second retractable unit 6. Specifically, the third side bar 51 is fixedly connected to the first and second substrates 11, 12, and is opposite to the first side bar 3 along the second direction (X). The fixed plate assembly 52 is mounted on the mounting surface 15 between the second side bar 4 and the second retractable unit 6, and includes a guide fixed plate 520 fixedly connected to the first substrate 11 and having a pair of inner rails 5201. In this embodiment, each inner rail 5201 is in the form of a groove having a T-shaped cross section, but is not limited thereto.

The side plate assembly 53 is inserted into the guide fixed plate 520 of the fixed plate assembly 52, and is extendable out of the same along the first direction (Y) to fixedly connect to the second side bar 4. The side plate assembly 53 includes a plurality of side plates 531 telescopically connected to one another and selectively fixed to the mounting surface 15 at any desired positions. In this embodiment, the side plate assembly 53 includes three side plates 531. Each side plate 531 has a pair of inner rails 5311 extending along a length thereof, and a pair of outer rails 5312 opposite to the pair of inner rails 5311 and extending also along the length thereof. In this embodiment, each inner rail 5311 is in the form of a groove having a T-shaped cross section, while each outer rail 5312 is in the form of a protrusion having a T-shaped cross section, but not limited thereto. Further, each outer rail 5312 of each side plate 531 is provided with a plurality of threaded holes 5313 spacedly arranged along the length thereof.

The pair of the outer rails 5312 of an outermost one of the side plates 531 are slidably engaged with the pair of the inner rails 5201 of the guide fixed plate 520 to limit the outermost side plate 531 to adjust the position thereof only along the first direction (Y). The pair of the outer rails 5312 of an innermost one of the side plates 531 are slidably engaged with the pair of the inner rails 5311 of an intermediate one of the side plates 531 to limit the innermost side plate 531 to adjust the position thereof only along the extending direction (Y). The pair of the outer rails 5312 of the intermediate side plate 531 are slidably engaged with the pair of the inner rails 5311 of the outermost side plate 531 to limit the intermediate side plate 531 to adjust the position thereof only along the extending direction (Y).

With reference to FIGS. 1 to 3, the first side connection assemblies 54 are used for fixedly connecting the side plates 531 to the second substrate 12. Specifically, two of the first side connection assemblies 54 are used for fixedly connecting the innermost side plate 531 to the second substrate 12, another two of the first side connection assemblies 54 are used for fixedly connecting the intermediate side plate 531 to the second substrate 12, and a fifth one of the first side connection assemblies 54 is used for fixedly connecting the outermost side plate 531 to the second substrate 12. Each first side connection assembly 54 includes a first side connector 541 and two first fixing screws 542. The first side connector 541 has an L-shaped body, and includes a first plate 5411 disposed on the second substrate 12, and a second plate 5412 perpendicular to the first plate 5411 and adjacent to a corresponding one of the side plates 531. One of the first fixing screws 542 is used for fixing the first plate 5411 to the second substrate 12, while the other first fixing screw 542 is used for fixing the second plate 5412 to the corresponding side plate 531.

Figure 9:
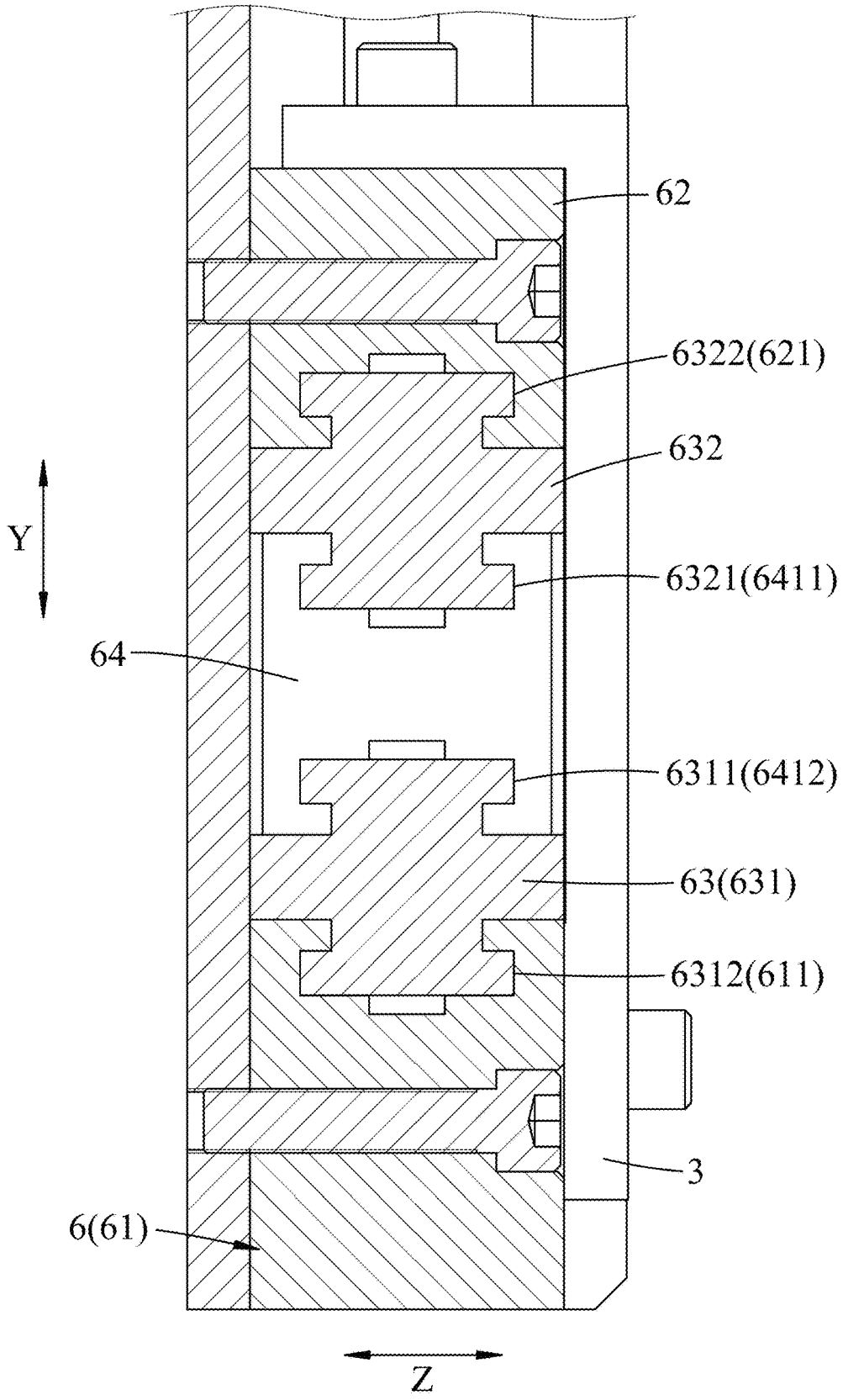
FIG. 9 is a sectional view taken along line IX-IX of FIG. 3.
Figure 10:
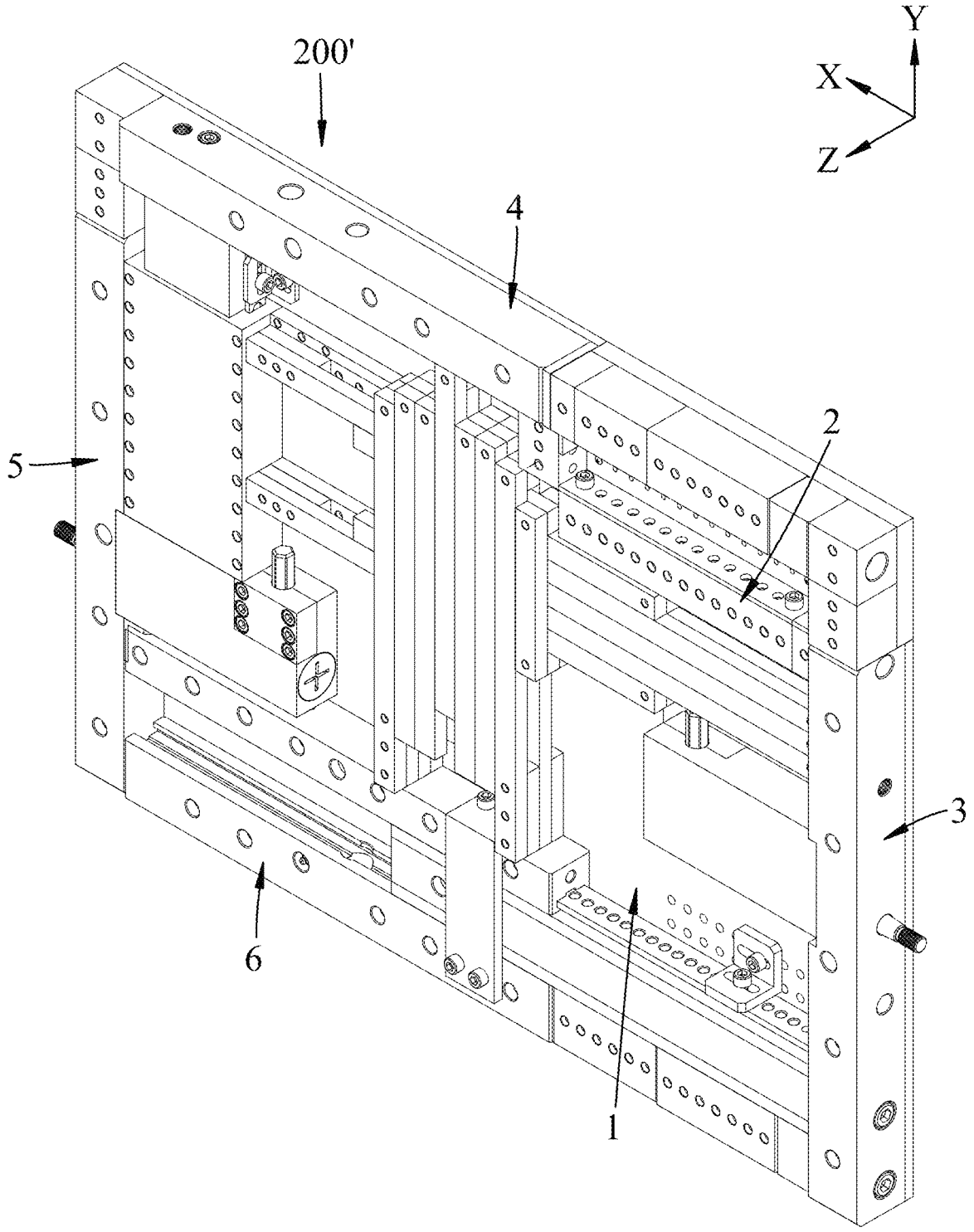
FIG. 10 is a perspective view of a two-way retractable building formwork apparatus according to the second embodiment of this disclosure.
Figure 11:
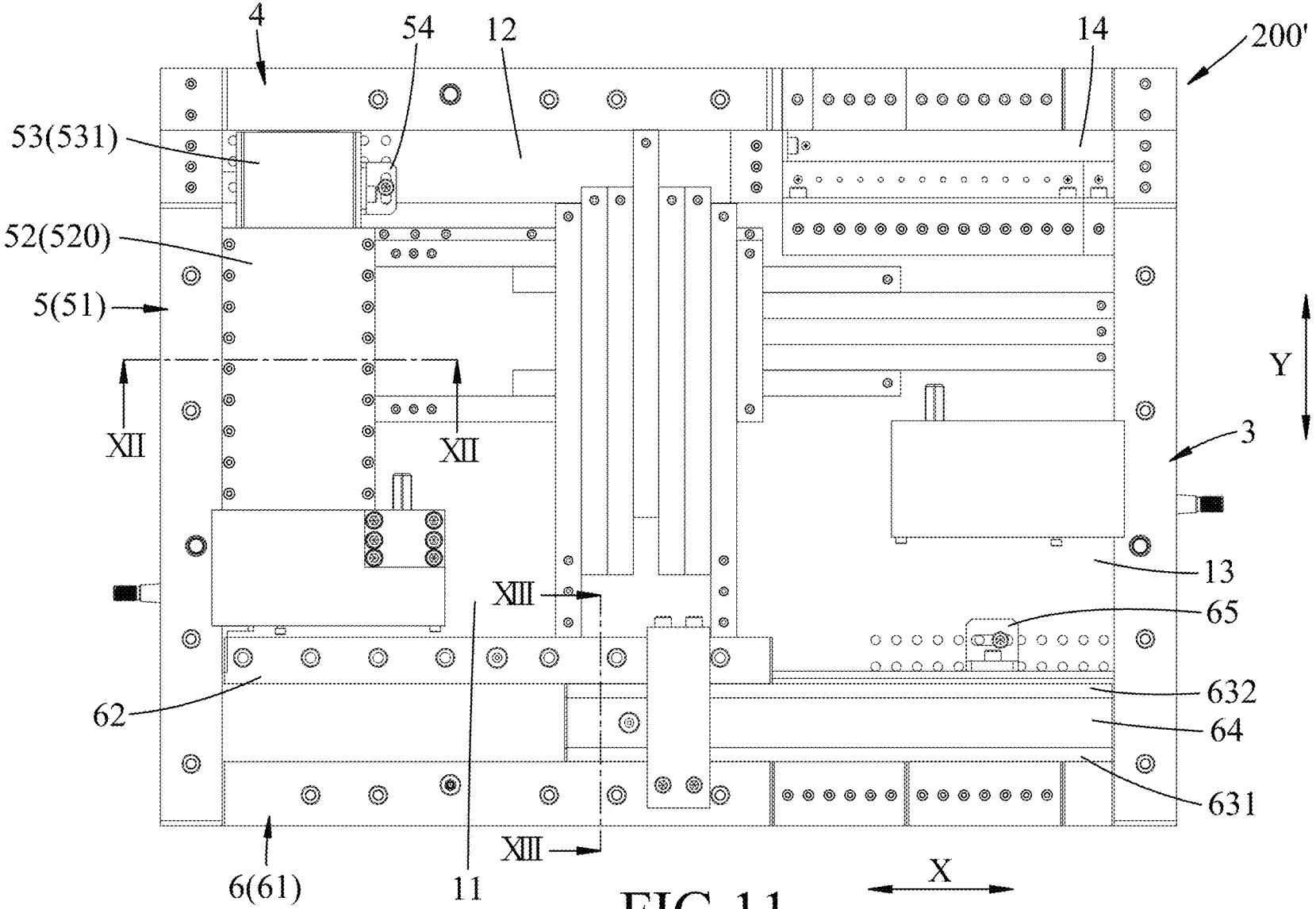
FIG. 11 is a front view of the second embodiment.
Figure 12:
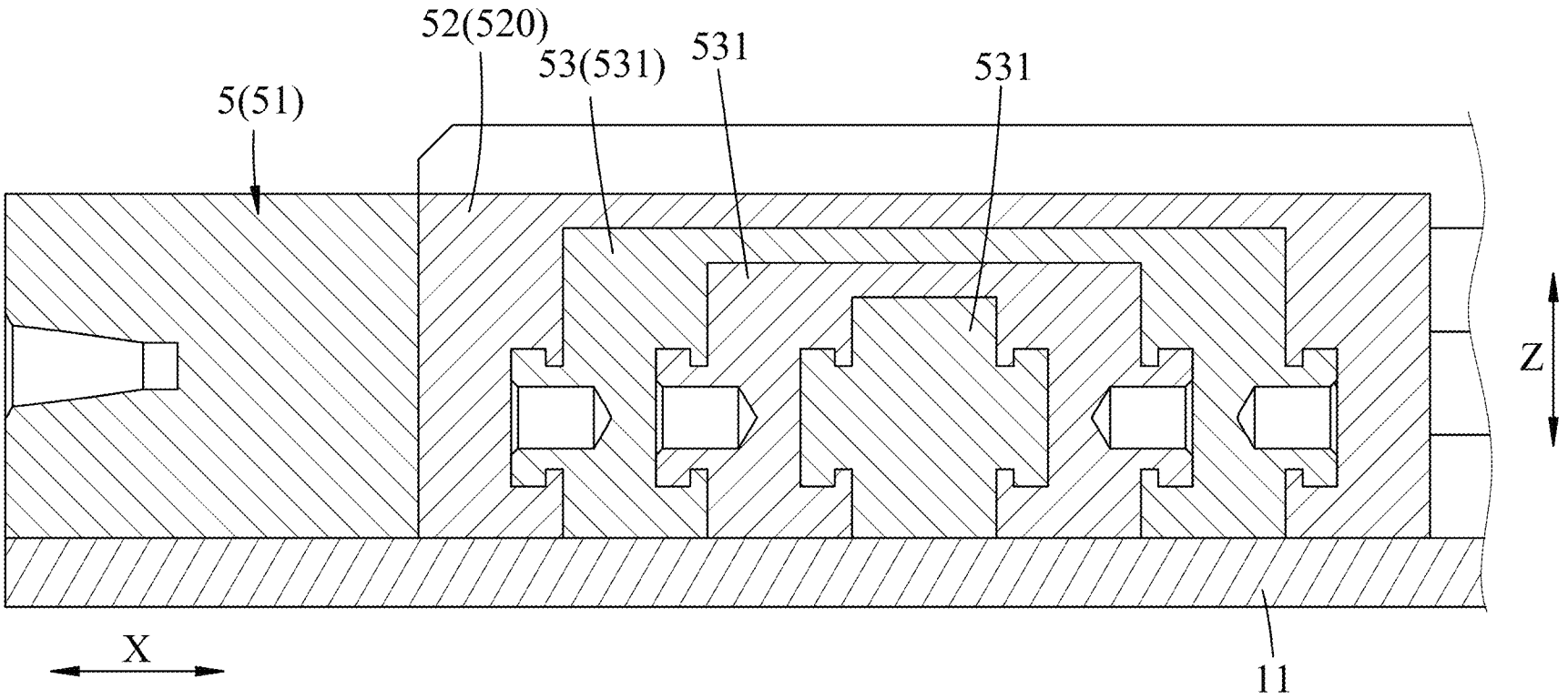
FIG. 12 is a sectional view taken along line XII-XII of FIG. 11.
Figure 13:
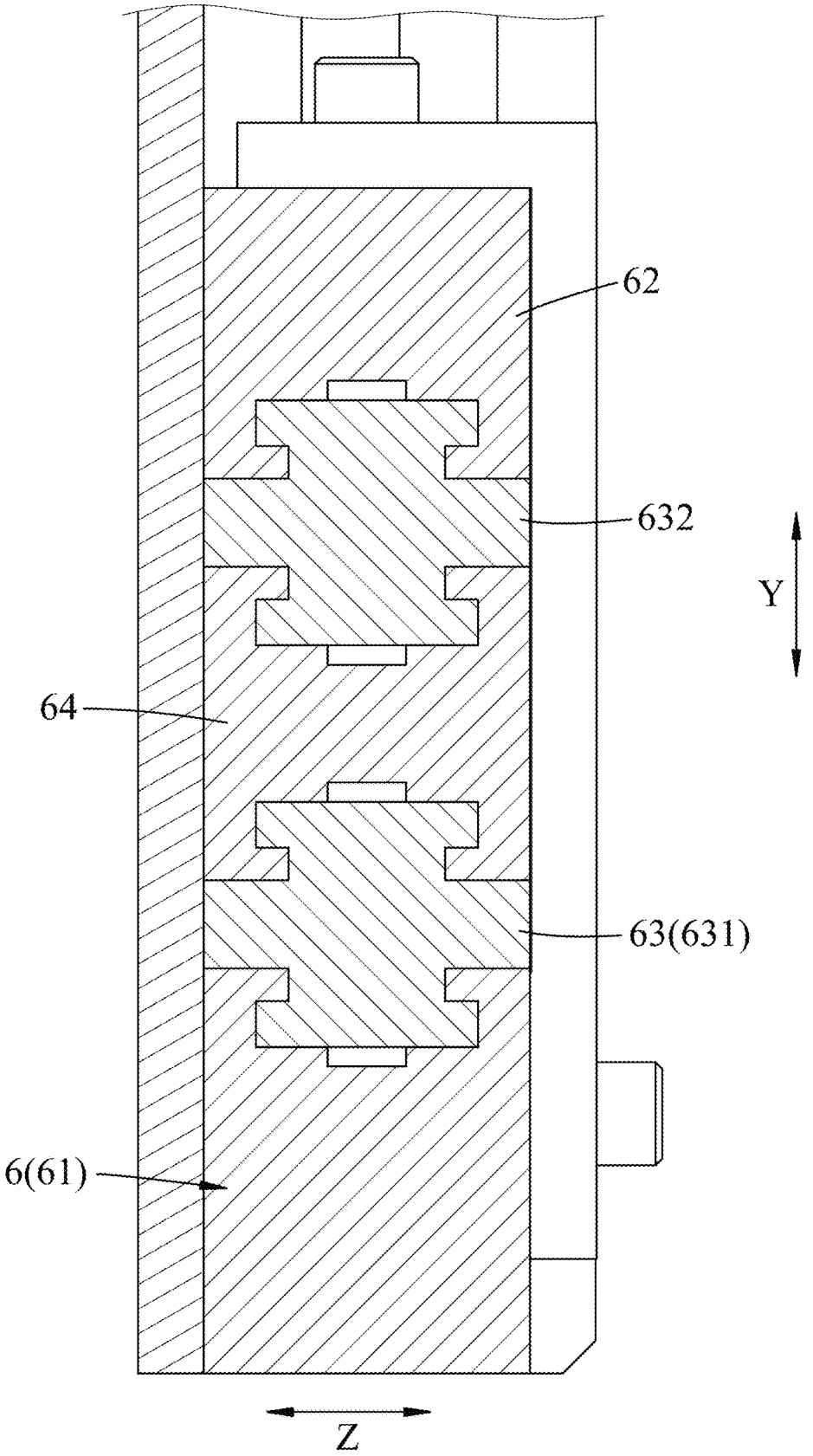
FIG. 13 is a sectional view taken along line XIII-XIII of FIG. 11.

Referring to FIG. 9, in combination with FIGS. 2 and 3, the second retractable unit 6 includes a first fixed plate 61, a second fixed plate 62, a connecting bar assembly 63, a slide bar assembly 64, and two second side connection assemblies 65. The first fixed plate 61 extends along the second direction (X), is mounted on a fourth end of the mounting surface 15 that is opposite to the another end thereof along the first direction (Y), and is connected between the other end of the first side bar 3 that is opposite to the one end thereof and one end of the third side bar 51 that is distal to the second side bar 4. Specifically, the first fixed plate 61 is opposite to the second side bar 4, and is disposed on the first and third substrates 11, 13. The second fixed plate 62 also extends along the second direction (X), is mounted on the mounting surface 15 spaced apart from and located inwardly of the first fixed plate 61 along the first direction (Y), and is connected to the third side bar 51. Specifically, the second fixed plate 62 is shorter than the first fixed plate 61, and is disposed on the first substrate 11. Each of the first and second fixed plates 61, 62 has a slide groove 611, 621 extending along a length thereof and having a T-shaped cross section. The slide grooves 611, 621 of the first and second fixed plates 611, 622 face each other.

The connecting bar assembly 63 includes a first connecting bar 631 and a second connecting bar 632 extending along the second direction (X) and located between the first and second fixed plates 61, 62. Each of the first and second connecting bars 631, 632 has an inner rail 6311, 6321 and an outer rail 6312, 6322 respectively provided on two sides thereof that are opposite along the first direction (Y) and extending along a length thereof. Each of the inner and outer rails 6311, 6321, 6312, 6322 has a T-shaped cross section. The outer rail 6312 of the first connecting bar 631 is slidably inserted into the slide groove 611 of the first fixed plate 61. The outer rail 6322 of the second connecting bar 632 is slidably inserted into the slide groove 621 of the second fixed plate 62. Through this configuration, the connecting bar assembly 63 are limited to adjust the position thereof only along the second direction (X), and can be selectively fixed to the mounting surface 15 at any desired position.

The slide bar assembly 64 of this embodiment includes a slide bar 641 extending along the second direction (X) and having an inner groove 6411 and an outer groove 6412 respectively provided on two sides thereof that are opposite along the first direction (Y) and extending along a length thereof. Each of the inner and outer grooves 6411, 6412 has a T-shaped cross section. The inner groove 6411 is slidably engaged with the inner rail 6321 of the second connecting bar 632, while the outer groove 6412 is slidably engaged with the inner rail 6311 of the first connecting bar 631. Through this configuration, the slide bar 641 is slidable between the first and second connecting bars 631, 632 along the second direction (X), and is limited to adjust the position thereof only along the second direction (X) so as to fixedly connect to the first side bar 3, and can be selectively fixed to the mounting surface 15 at any desired position.

The second side connection assemblies 65 are used for connecting fixedly and respectively the slide bar 641 and the second connecting bar 632 to the third substrate 13. Specifically, each second connection assembly 65 includes a second side connector 651 and two second fixing screws 652. The second side connector 651 has an L-shaped body, and includes a first plate 6511 disposed on the third substrate 13, and a second plate 6512 perpendicular to the first plate 6511 and adjacent to the second connecting bar 632. One of the second fixing screws 652 of one of the second connection assemblies 65 is used for fixing the first plate 6511 to the third substrate 13, while the other second fixing screw 652 thereof is used for fixing the second plate 6512 to the second connecting bar 632. One of the second fixing screws 652 of the other second connection assembly 65 is used for fixing the first plate 6511 thereof to the third substrate 13, while the other second fixing screw 652 thereof is used for fixing the second plate 6512 to the slide bar 641.

In use, a plurality of basic building formworks (not shown) are first made according to a wall to be constructed, and then, according to the length difference between an assembly of the basic building formworks and the wall to be constructed, the substrate module 1 that meets the length difference is further manufactured, after which the two-way retractable building formwork apparatus 200 is mounted to the substrate module 1.

When using this embodiment, because of the adjustment of the lengths that can be made along the first direction (Y) and the second direction (X), the size of the fourth substrate 14 can be varied, so that it is difficult to reuse the fourth substrate 14. Since the fourth substrate 14 is made of wood that is easy to cut, it can be directly treated as waste after using it. Compared with using a metal material, the cost of manufacturing the fourth substrate 14 can be reduced.

In this embodiment, the two-way retractable building formwork apparatus 200 further includes a first auxiliary retractable unit 6' located on the first and second substrates 11, 12, and a second auxiliary retractable unit 6" located on the first and third substrates 11, 13, as shown in FIGS. 1 to 3. Since the structure and function of each of the first and second auxiliary retractable unit 6', 6" are substantially identical to those of the second retractable unit 6, a detailed description thereof is omitted herein for the sake of brevity.

Referring to FIGS. 10 to 13, a two-way retractable building formwork apparatus 200' according to the second embodiment of this disclosure is shown to be identical to the first embodiment, but differs in that, in the second embodiment, the innermost side plate 531 and the intermediate side plate 531 of the side plate assembly 53 are not extended out of the guide fixed plate 520 of the fixed plate assembly 52, and the outermost side plate 531 is partially extended out of the guide fixed plate 520. Further, the number of the first side connection assembly 54 is one. The first side connection assembly 54 fixedly connects the outermost side plate 531 to the second substrate 12.

Moreover, the slide bar 641 of the slide bar assembly 64 is located between the first and second connecting bars 631, 632 of the connecting bar assembly 63, and is fixedly connected to the first side bar 3 without extending out of the connecting bar assembly 63. The number of the second side connection assembly 65 is one. The second side connection assembly 65 fixedly connects the second connecting bar 632 to the third substrate 13.

Therefore, the second embodiment can achieve the same effect as that of the first embodiment.

Figure 14:
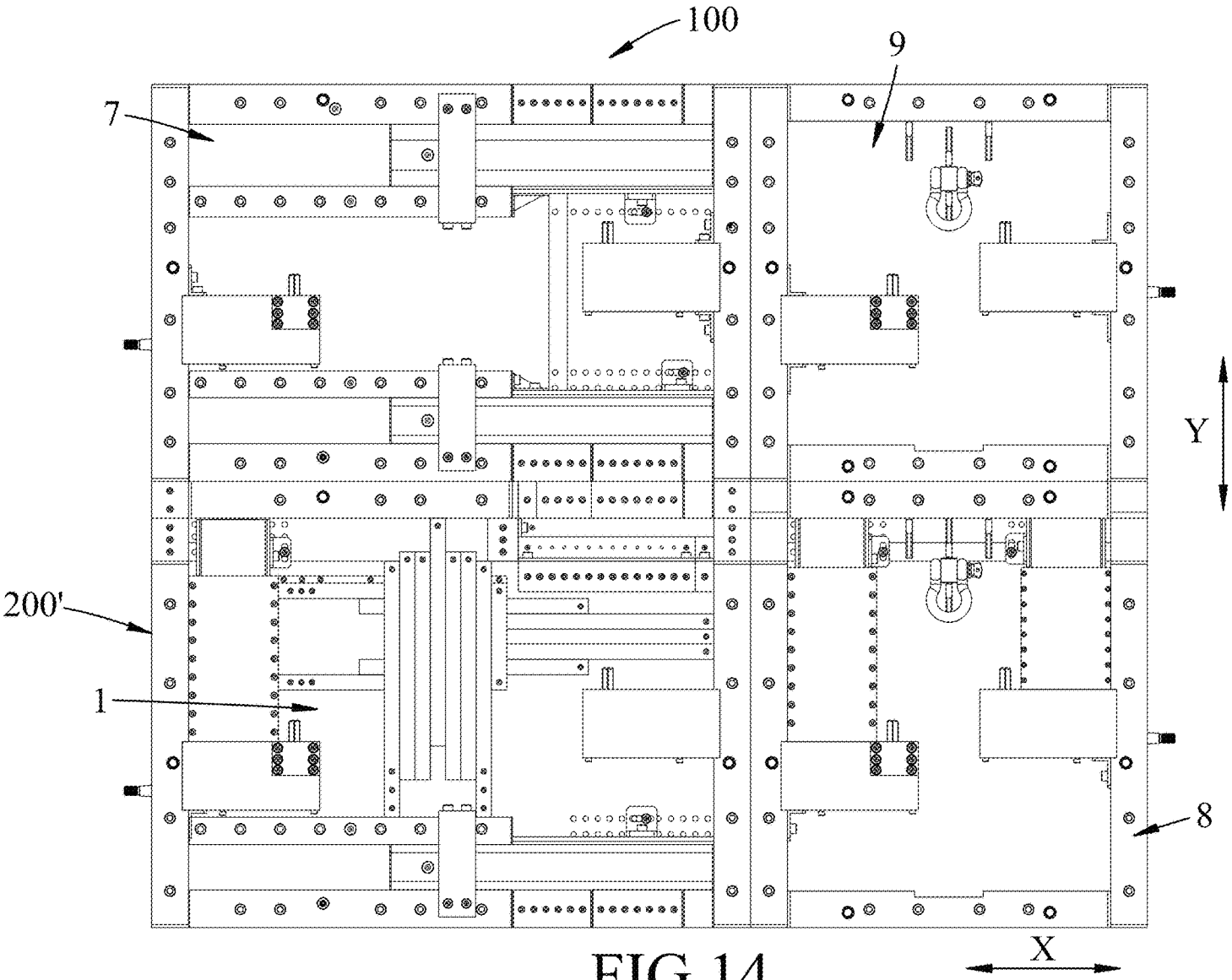
FIG. 14 is a schematic front view illustrating the second embodiment being combined with a first building formwork, a second building formwork and a third building formwork to form a formwork wall.

Referring to FIG. 14, the two-way retractable building formwork apparatus 200' of the second embodiment is spliced with a first building formwork 7, a second building formwork 8 and a third building formwork 9 of different sizes to form a rectangular formwork wall 100.

The first building formwork 7 is connected side by side with the second embodiment along the first direction (Y), while the second building formwork 8 is connected side by side with the second embodiment along the second direction (X). The third building formwork 9 is connected side by side with the first building formwork 7 along the second direction (X), and is connected side by side with the second building formwork 8 along the first direction (Y).

By using the two-way retractable building formwork apparatus 200' to match the length of the second building formwork 8 along the first direction (Y) and the length of the first building formwork 7 along the second direction (X), after assembly of the two-way retractable building formwork apparatus 200' and the first to third building formworks 7, 8, 9, they can meet the size of a wall to be constructed, thereby saving the cost of manual construction.

In summary, in the two-way retractable building formwork apparatus 200, 200' of this disclosure, with the first and second retractable units 5, 6 being retractably connected to the substrate module 1 and the first and second side bars 3, 4, and being fixed to the fourth substrate 14, the second substrate 12 and the third substrate 13 by the fixing unit 2, the structure of the substrate module 1 can be strengthened, and the mold surface 16 can be kept flat. In comparison with the existing building formwork apparatus which must spend labor and material costs for customizing the existing building formwork apparatus, the two-way retractable building formwork apparatus 200, 200' of the present disclosure can achieve the effect of cost reduction. Therefore, the object of this disclosure can indeed be achieved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A two-way retractable building formwork apparatus, comprising:

a substrate module having a mounting surface;

a first side bar mounted on one end of said mounting surface that extends along a first direction;

a second side bar mounted on another end of said mounting surface that extends along a second direction transverse to the first direction and fixed to one end of said first side bar;

a first retractable unit mounted on said mounting surface opposite to said first side bar and extendable along the first direction to fixedly connect to said second side bar; and a second retractable unit mounted on said mounting surface opposite to said second side bar and extendable along the second direction to fixedly connect to said first side bar, said second retractable unit being further connected to said first retractable unit;

wherein said first retractable unit includes a third side bar, a fixed plate assembly, and a side plate assembly, said third side bar extending along the first direction, being mounted on a third end of said mounting surface that is opposite to said one end of said mounting surface, and being fixed between one end of said second side bar that is opposite to said one end of said first side bar and said second retractable unit, said fixed plate assembly being mounted on said mounting surface between said second side bar and said second retractable unit, said side plate assembly being inserted into said fixed plate assembly and being extendable out of said fixed plate assembly along the first direction to fixedly connect to said second side bar, said side plate assembly being fixed to said mounting surface.

2. The two-way retractable building formwork apparatus as claimed in claim 1, wherein:

said second retractable unit includes a first fixed plate, a second fixed plate, a connecting bar assembly, and a slide bar assembly;

said first fixed plate extends along the second direction, is mounted on a fourth end of said mounting surface that is opposite to said another end of said mounting surface, and is connected between another end of said first side bar that is opposite to said one end of said first side bar and one end of said third side bar that is distal to said second side bar;

said second fixed plate extends along the second direction, and is mounted on said mounting surface spaced apart from and located inwardly of said first fixed plate along the first direction;

said connecting bar assembly is slidably engaged between said first fixed plate and said second fixed plate, and is fixed to said mounting surface;

said slide bar assembly is slidably engaged with said connecting bar assembly along the second direction and is fixedly connected to said first side bar, said slide bar assembly being fixed to said mounting surface.

3. The two-way retractable building formwork apparatus as claimed in claim 2, wherein:

said substrate module includes a first substrate, a second substrate, a third substrate, and a fourth substrate;

said third substrate is connected side by side to said first substrate along the second direction, said first fixed plate being disposed on said first substrate and said third substrate;

said second substrate is connected side by side to said first substrate at a side that is opposite to said first fixed plate along the first direction, said third side bar being disposed on said first substrate and said second substrate, and being connected to said first fixed plate and said second fixed plate;

said fourth substrate is connected side by side to said second substrate along the second direction and is connected side by side to said third substrate along the first direction, said first side bar being disposed on said third substrate and said fourth substrate, and being opposite to said third side bar along the second direction;

said second side bar is disposed on said second substrate and said fourth substrate, and is opposite to said first fixed plate along the first direction;

said substrate module further has a mold surface opposite to said mounting surface along a mounting direction transverse to the first direction and the second direction; and said first substrate, said second substrate, said third substrate and said fourth substrate cooperatively define said mounting surface and said mold surface.

4. The two-way retractable building formwork apparatus as claimed in claim 3, wherein said mold surface is flat, and said fourth substrate has a thickness along the mounting direction greater than a thickness of any one of said first substrate, said second substrate and said third substrate along the mounting direction.

5. The two-way retractable building formwork apparatus as claimed in claim 4, wherein:

said first side bar has a first portion abutting against said fourth substrate and having a thickness along the mounting direction, and a second portion abutting against said third substrate and having a thickness along the mounting direction greater than that of said second portion such that a thickness of a combination of said second portion of said first side bar and said third substrate along the mounting direction is equal to a thickness of a combination of said first portion of said first side bar and said fourth substrate along the mounting direction; and said second side bar has a first portion abutting against said fourth substrate and having a thickness along the mounting direction and a second portion abutting against said second substrate and having a thickness along the mounting direction greater than that of said first portion of said second side bar such that a thickness of a combination of said second portion of said second side bar and said second substrate along the mounting direction is equal to a thickness of a combination of said first portion of said second side bar and said fourth substrate along the mounting direction.

* * * * *